US011493177B2

(12) United States Patent
Doberstein et al.

(10) Patent No.: US 11,493,177 B2
(45) **Date of Patent: *Nov. 8, 2022**

(54) TASK-AREA LIGHT

(71) Applicant: MILWAUKEE ELECTRIC TOOL CORPORATION, Brookfield, WI (US)

(72) Inventors: Emily C. Doberstein, San Diego, CA (US); Josh Adams, Milwaukee, WI (US); Alan Amundson, Milwaukee, WI (US); Benjamin D. Gall, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/207,918

(22) Filed: Mar. 22, 2021

(65) Prior Publication Data

US 2021/0207779 A1 Jul. 8, 2021

Related U.S. Application Data

(63) Continuation of application No. 16/777,438, filed on Jan. 30, 2020, now Pat. No. 10,969,065, which is a (Continued)

(51) Int. Cl.

| | |
|---|---|
| ***F21L 4/02*** | (2006.01) |
| ***F21L 4/08*** | (2006.01) |
| ***F21V 3/02*** | (2006.01) |
| ***F21V 23/02*** | (2006.01) |
| ***F21L 4/04*** | (2006.01) |
| ***F21V 23/00*** | (2015.01) |
| ***F21V 29/503*** | (2015.01) |

(Continued)

(52) U.S. Cl.

CPC ..... *F21L 4/02* (2013.01); *F21L 4/04* (2013.01); *F21L 4/08* (2013.01); *F21V 3/02* (2013.01);

(Continued)

(58) Field of Classification Search

CPC ..... F21L 4/02; F21L 4/08; F21L 4/04; F21L 4/027; F21V 3/02; F21V 23/02;

(Continued)

(56) References Cited

U.S. PATENT DOCUMENTS 4,181,928 A * 1/1980 Zelina ..... F21L 2/00 362/240

5,860,729 A 1/1999 Bamber (Continued)

FOREIGN PATENT DOCUMENTS

DE 20206201 U1 8/2002
KR 1020160103733 A 6/2016

OTHER PUBLICATIONS

International Search Report and Written Opinion for Application No. PCT/US2018/054362 dated Feb. 22, 2019, (11 pages).

(Continued)

*Primary Examiner* — Peggy A Neils

(74) *Attorney, Agent, or Firm* — Michael Best & Friedrich LLP

(57) ABSTRACT

A light assembly includes a base, and a first light source supported by the base. The first light source includes a first light emitting diode configured to emit light in a first direction from the base. The light assembly additionally includes a second light source supported by the base, the second light source including a plurality of second light emitting diodes configured to emit light in a second direction from the base. The second light source is obliquely oriented relative to the base. The light assembly additionally includes a diffuser supported by the base, the diffuser extending upwardly from the base to enclose the first light source. The diffuser diffuses light emitted from the first light source to the surrounding area in an upward and outward direction.

20 Claims, 11 Drawing Sheets

Related U.S. Application Data continuation of application No. 16/151,873, filed on Oct. 4, 2018, now Pat. No. 10,551,013.

(60) Provisional application No. 62/569,319, filed on Oct. 6, 2017.

(51) Int. Cl.
*F21W 131/402* (2006.01)
*F21V 21/40* (2006.01)
*F21Y 115/10* (2016.01)

(52) U.S. Cl.
CPC ..... *F21V 23/003* (2013.01); *F21V 23/02* (2013.01); *F21V 29/503* (2015.01); *F21V 21/406* (2013.01); *F21W 2131/402* (2013.01); *F21Y 2115/10* (2016.08)

(58) Field of Classification Search
CPC .... F21V 23/003; F21V 29/503; F21V 21/406; F21W 2131/402; F21Y 2115/10
See application file for complete search history.

(56) References Cited

U.S. PATENT DOCUMENTS

| | | | | |
|---|---|---|---|---|
| 6,056,414 | A | 5/2000 | Krieger | |
| 7,063,438 | B2 | 6/2006 | Sze-Tai | |
| 7,121,678 | B1 | 10/2006 | Shetter | |
| 7,347,582 | B1 | 3/2008 | Kung | |
| 7,401,941 | B2 | 7/2008 | Teng et al. | |
| 7,651,240 | B2 * | 1/2010 | Bayat | F21V 7/0091 362/208 |
| 9,217,548 | B2 | 12/2015 | Shen | |
| 10,378,744 | B2 * | 8/2019 | Arena | F21V 23/06 |
| 10,458,631 | B2 * | 10/2019 | Dorman | F21V 21/0885 |
| 10,551,013 | B2 * | 2/2020 | Doberstein | F21V 23/003 |
| 2005/0270771 | A1 | 12/2005 | Yuen | |
| 2006/0109662 | A1 | 5/2006 | Reiff et al. | |
| 2010/0053942 | A1 | 3/2010 | Tarter et al. | |
| 2012/0155077 | A1 | 6/2012 | Kim et al. | |
| 2012/0206915 | A1 | 8/2012 | Batty | |
| 2015/0267902 | A1 | 9/2015 | Zhang | |
| 2015/0300581 | A1 | 10/2015 | Huang | |
| 2016/0223185 | A1 | 8/2016 | Harvey et al. | |
| 2016/0348879 | A1 | 12/2016 | Young et al. | |
| 2017/0045185 | A1 | 2/2017 | Mumma | |
| 2018/0128435 | A1 | 5/2018 | Workman et al. | |

OTHER PUBLICATIONS

Extended European Search Report for Application No. PCT/US2018/054362 dated Apr. 23, 2021 (9 pages).
Extended European Search Report for Application No. 18863965.2 dated Apr. 23, 2021 (9 pages).

* cited by examiner

TASK-AREA LIGHT

CROSS-REFERENCE TO RELATED APPLICATIONS

This application is a continuation of U.S. patent application Ser. No. 16/777,438, filed on Jan. 30, 2020, now U.S. Pat. No. 10,969,065, which is a continuation of U.S. patent application Ser. No. 16/151,873, filed Oct. 4, 2018, now U.S. Pat. No. 10,551,013, which claims priority to U.S. Provisional Patent Application No. 62/569,319, filed Oct. 6, 2017, the entire contents of which are incorporated by reference herein.

FIELD OF THE INVENTION

The present invention relates to lighting devices, and more particularly to portable workspace lighting devices.

SUMMARY

In one aspect, the invention provides a light assembly including a base, a first light source supported by the base, the first light source including an area light emitting diode configured to emit light in a first direction from the base, a second light source supported by the base, the second light source including four flood light emitting diodes arranged in a square grid and configured to emit light in a second direction from the base, a diffuser supported by the base, the diffuser extending upwardly from the base to enclose the first light source, and a control panel supported by the base and including an actuator operable to control operation of the light assembly.

In another aspect, the invention provides a light assembly including a base having a receiving port, a heat sink positioned within the base, the heat sink including a first portion and a second portion that is angled relative to the first portion, a first light source supported on the first portion of the heat sink, the first light source including an area light emitting diode configured to emit light in an upward direction from the base, a second light source supported on the second portion of the heat sink, the second light source including a flood light emitting diode configured to emit light from a side of the base, a diffuser supported by the base, the diffuser extending upwardly from the base to enclose the first light source, and a battery pack removably received in the receiving port of the base.

In another aspect, the invention provides a light assembly including a base having a top, a bottom, a first side, and a second side opposite the first side, a first light source positioned on the top of the base, the first light source including an area light emitting diode configured to emit light in a first direction from the base, a second light source positioned on the first side of the base, the second light source including a flood light emitting diode configured to emit light in a second direction from the base, a diffuser positioned on the top of the base, the diffuser extending upwardly from the base to enclose the first light source, a first power input positioned on the second side of the base, the first power input electrically coupled to the first light source and the second light source, the first power input configured to selectively receive power from a first power source, and a control panel positioned on the second side of the base, the control panel including a power actuator.

Other aspects of the invention will become apparent by consideration of the detailed description and accompanying drawings.

DETAILED DESCRIPTION

Figure 1A:
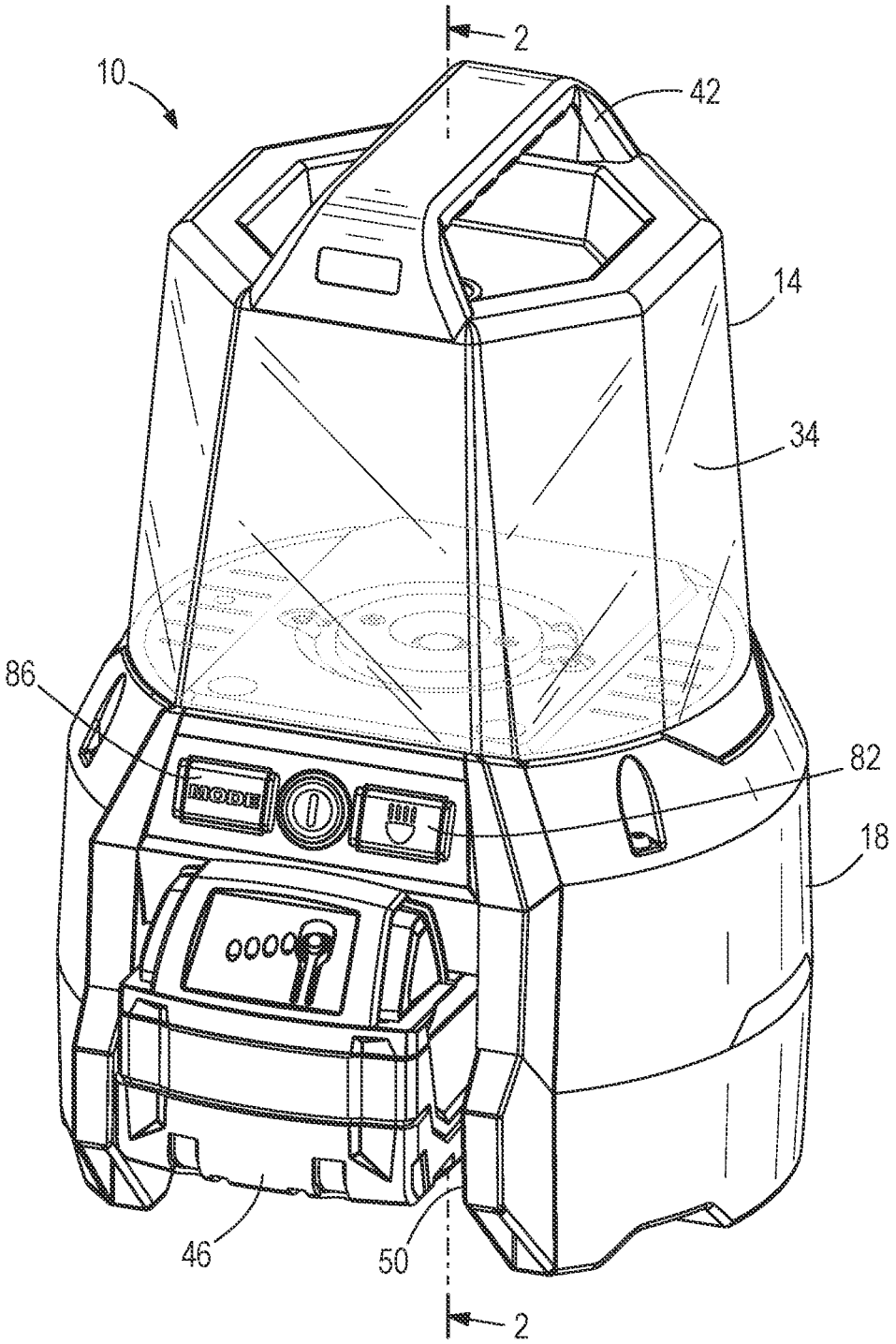
FIGS. 1A-1B are front and rear perspective views, respectively, of a task-area light.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1A-3B illustrate a light assembly 10 configured to provide illumination to a workspace. The light assembly 10 may also be referred to as a task-area light. The task-area light 10 may be held by a user, supported on a support surface, or hung on a support member using features discussed in greater detail below. In addition, the task-area light 10 may be controlled via a control panel 26 to operate in multiple lighting modes.

In the illustrated embodiment, the task-area light 10 includes an area light 14 and a base 18. The illustrated base 18 is generally cylindrical and supports a flood light 22 and the control panel 26. The area light 14 is configured to emit light in a 360 degree range, while the flood light 22 is configured to emit light via a light source 62 (e.g., light emitting diodes) in a specific direction. The control panel 26 is electrically connected to the area light 14 (via a light source 38) and the flood light 22 (via the light source 62) to control the lights; for example, to turn the lights on and off, either together or separately.

The area light 14 includes a diffuser 34 and the light source 38. In the illustrated embodiment, the light source 38 is a single area light emitting diode (LED), such as a single chip-on-board (COB) LED. In other embodiments, the light source 38 may include multiple LEDs. The diffuser 34, or lens, is supported by and extends upwardly from the base 18. The illustrated light source 38 is arranged to emit light generally upward from the base 18. The diffuser 34 surrounds and encloses the light source 38 (FIGS. 2 and 4) to help protect the light source 38. The diffuser 34 also diffuses light emitted from the light source 38 to the surrounding area (e.g., in an upward and outward direction from the base 18). In some embodiments, the diffuser 34 may be detachably coupled to the base 18. For example, the diffuser 34 may be coupled to the base 18 using a set of fasteners, a ball detent, an interference fit, or other suitable mechanisms.

Figure 1B:
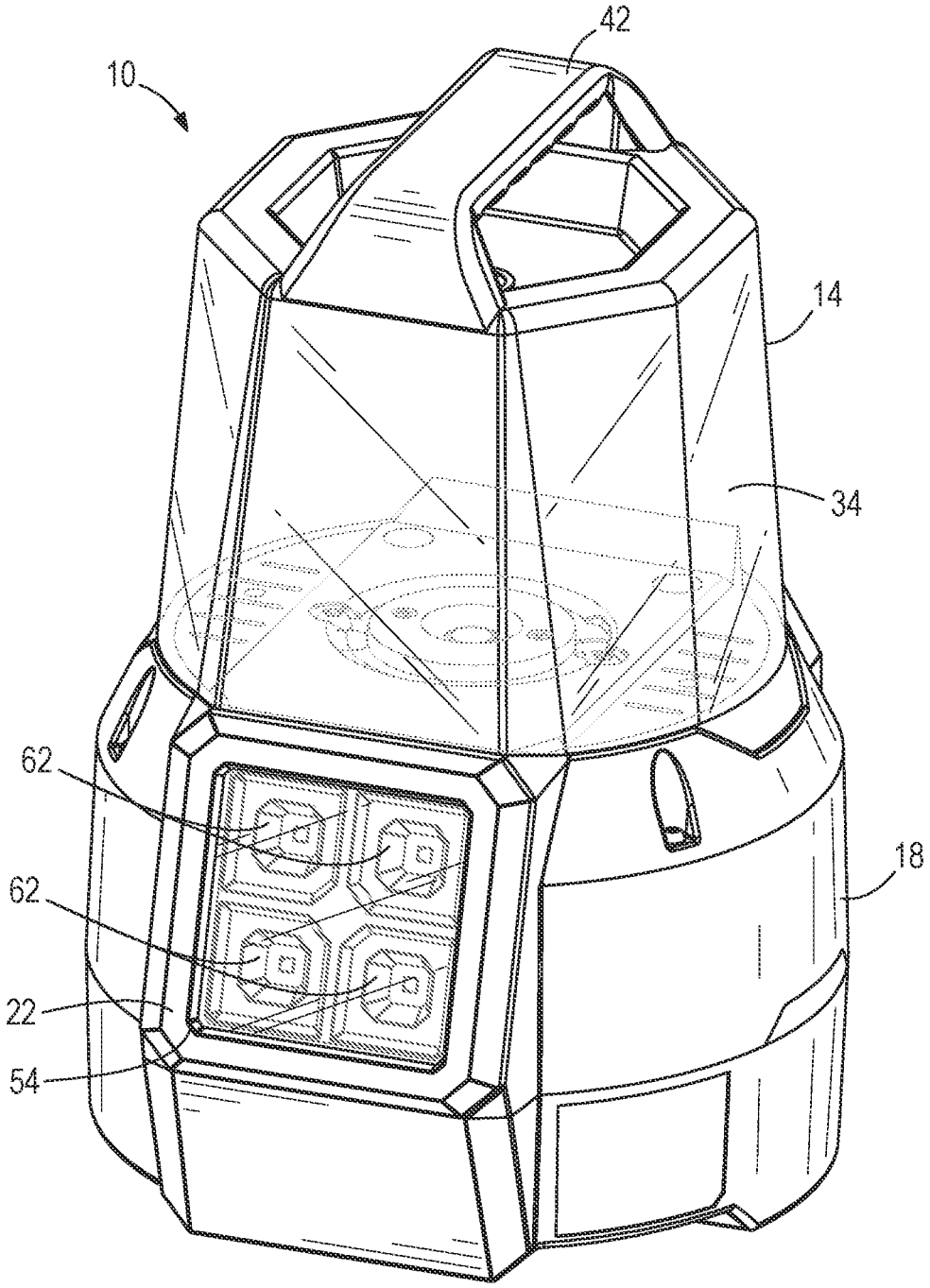
Figure 2:
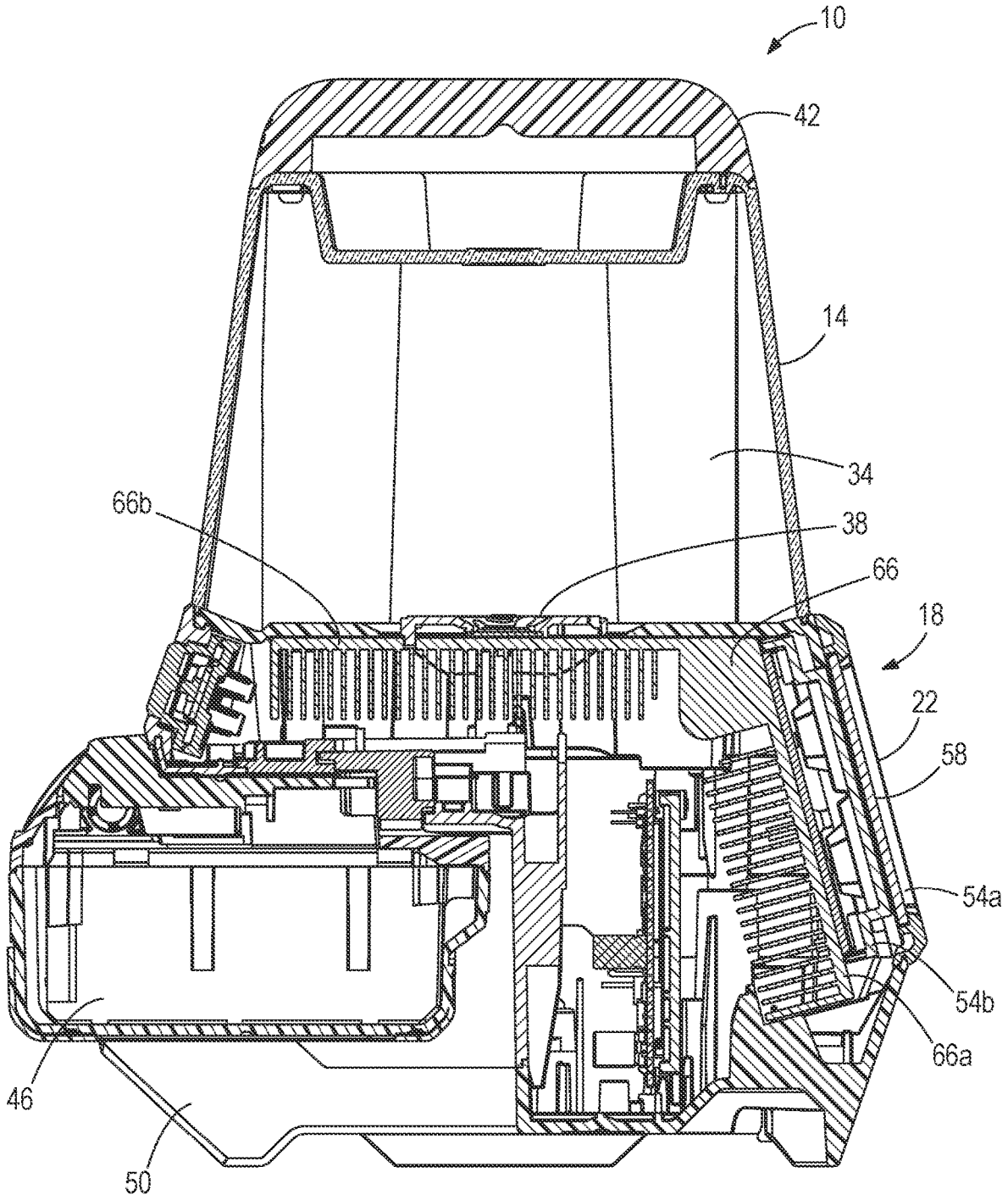
FIG. 2 is a cross-sectional view of the task-area light taken along section line 2-2 of FIG. 1A.

With continued reference to FIGS. 1-3, the area light 14 includes a handle 42 having a grip portion for grasping by a user. The handle 42 is coupled to an upper end of the diffuser 34 opposite the base 18. In the illustrated embodiment, the handle 42 is fixed (i.e., immovable) relative to the diffuser 34. In other embodiments, the handle 42 may be movably (e.g., slidably, pivotably, etc.) coupled to the diffuser 34 for deployment between a stowed position and a use position. The handle 42 also can be hung on a support structure (e.g., a hook, a rod, etc.) to hang the task-area light 10 above a support surface.

Figure 5:
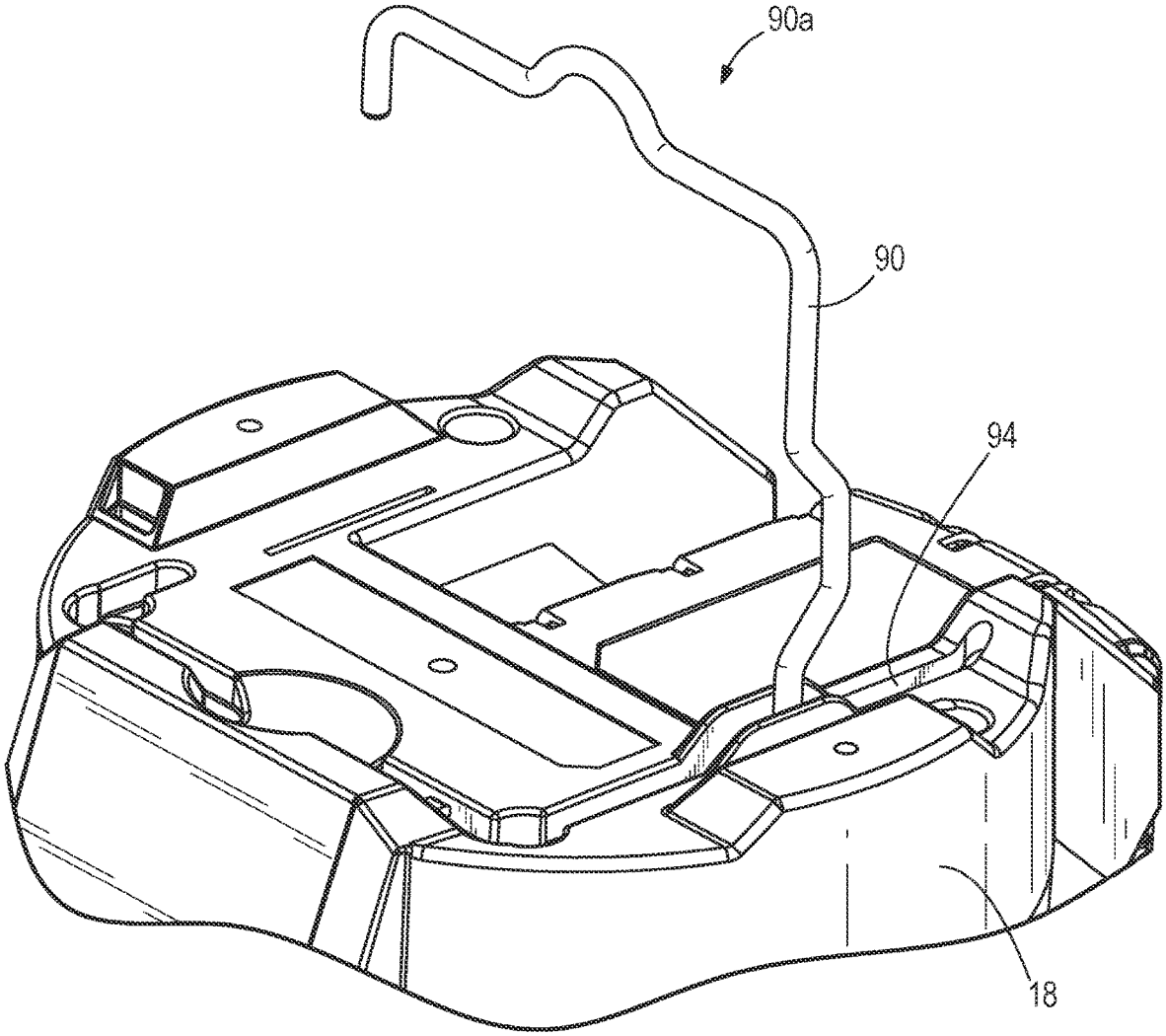
FIG. 5 is a bottom perspective view of a portion of the task-area light, illustrating a hanging hook in an extended position.
Figure 6:
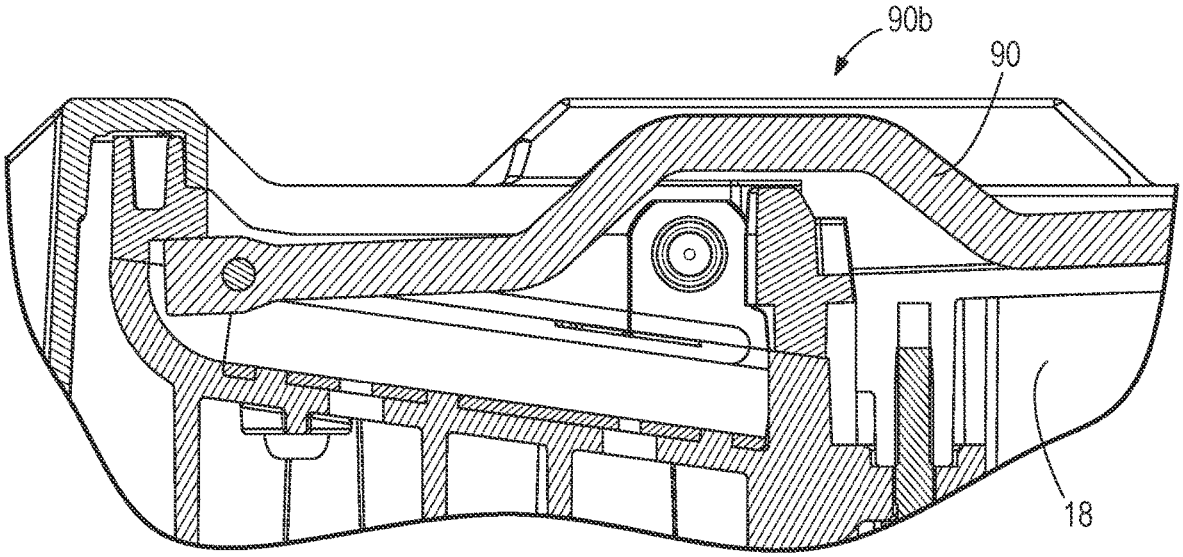
FIG. 6 is a cross-sectional view of a portion of the hanging hook of FIG. 5 while in a stowed position.
Figure 7:
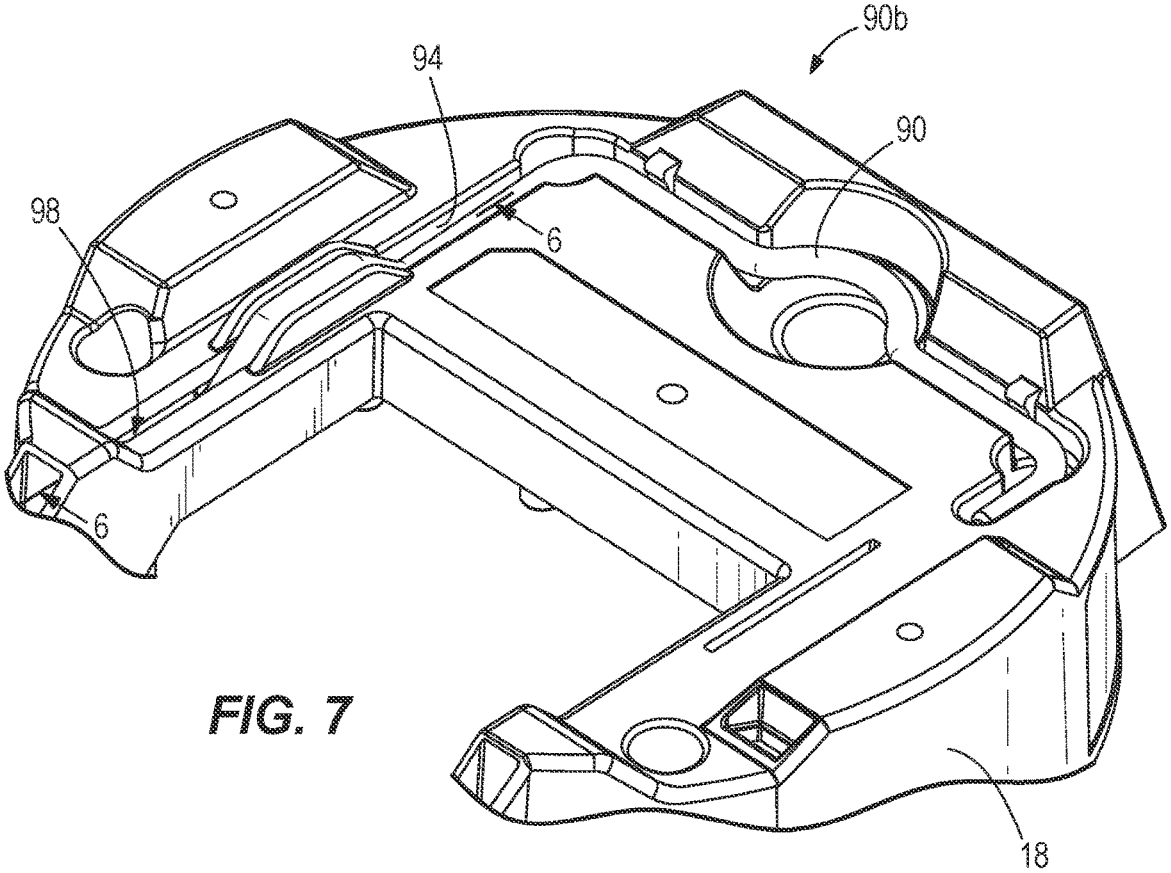
FIG. 7 is a bottom perspective view of a portion of the task-area light, illustrating the hanging hook of FIG. 5 in the stowed position.
Figure 8:
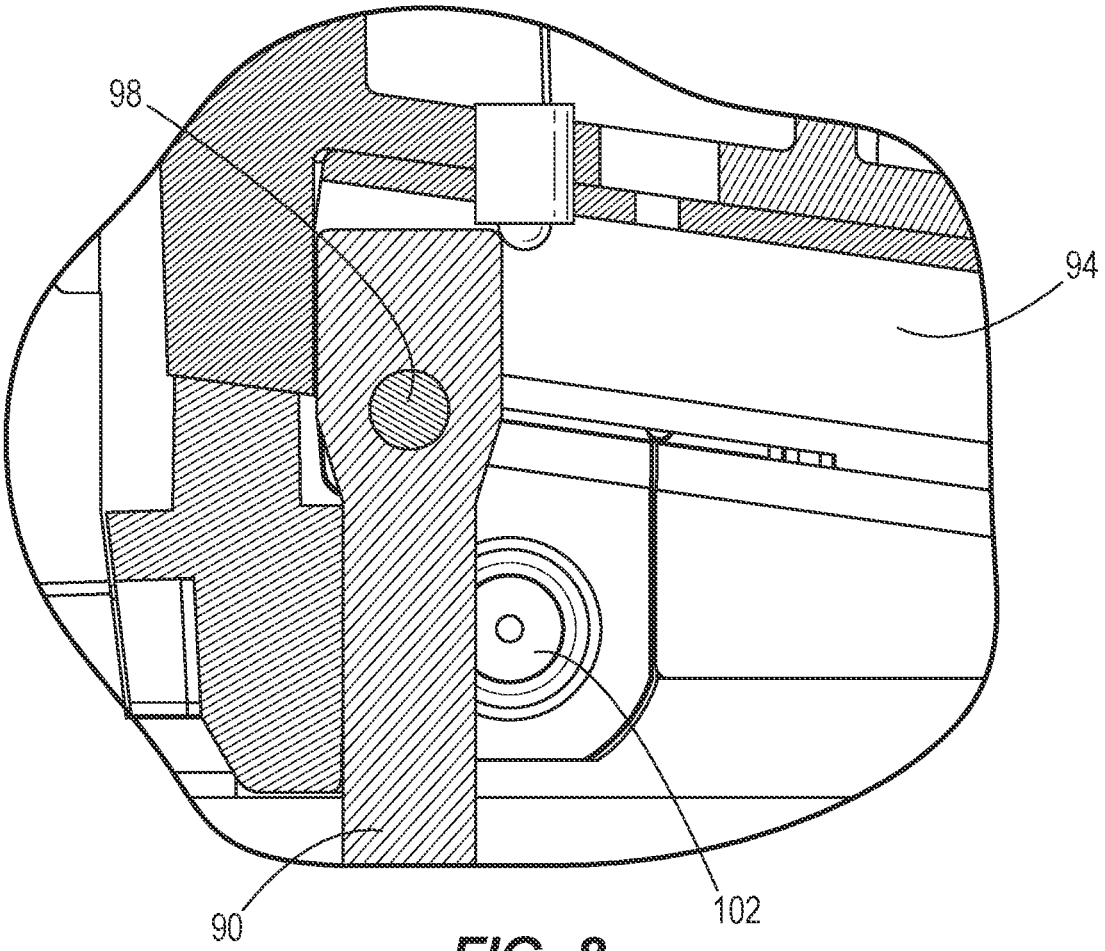
FIG. 8 is a cross-sectional view of a portion of the hanging hook of FIG. 5 while in the extended position.
Figure 9:
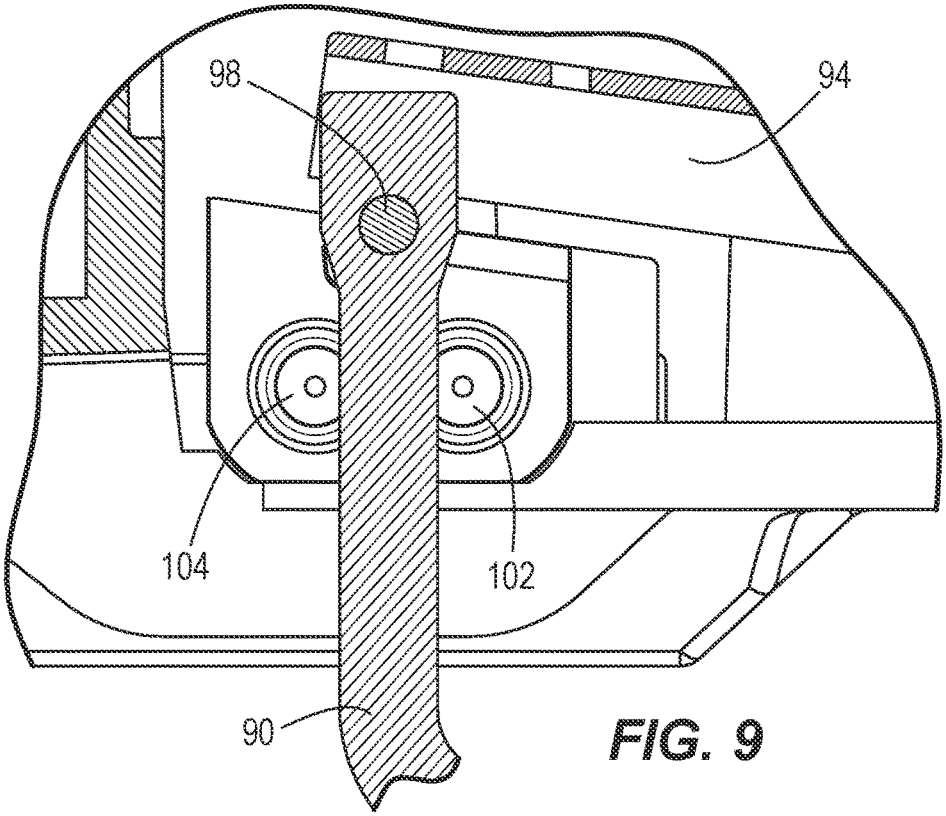
FIG. 9 is another cross-sectional view of a portion of the hanging hook of FIG. 5 while in the extended position, illustrating two detents.
Figure 10:
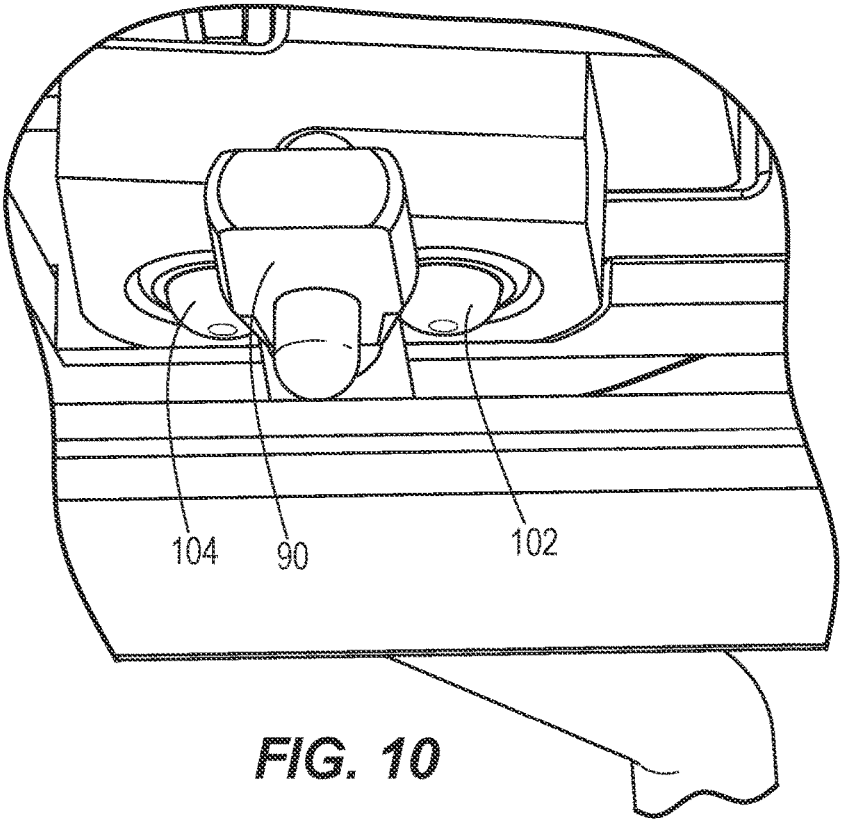
FIG. 10 is a bottom perspective view of the hanging hook and the two detents of FIG. 9.

The task-area light 10 also includes a hanging hook 90 coupled to the base 14. In particular, the hanging hook 90 is coupled to a bottom surface of the base 18, opposite from the diffuser 34. The illustrated hanging hook 90 is movable between an extended position 90*a* (FIG. 5) for use and a stowed position 90*b* (FIGS. 6 and 7) in the bottom surface of the base 18. A track 94 is formed in the base for retaining the hook 90 in the stowed position 90*b*. The hook 90 is pivotally attached to the base 18 at a pivot point 98. A detent 102 (FIG. 8) retains the hook 90 in either the extended position 90*a* and/or in the stowed position 90*b*. The detent 102 extends into the track 94 and contacts the hook member 90 to prohibit the hook member 90 from extending past a certain point when the hanging hook 90 is extending from the base 18. When the hook 90 is in the stowed position, the hook 90 does not extend beyond the bottom surface of the base 18. In further embodiments, the base 18 may include two or more detents 102, 104 on opposite sides of the hanging hook 90, as shown in FIGS. 9 and 10. When the hook 90 is in the extended position, the hook 90 can engage a support structure (e.g., a rafter, a hook, a rod, a nail, etc.) to hang the task-area light 10 from the support structure. In another embodiment, the hanging hook 90 may include two or more hook members coupled to the base 18. In such embodiments, the hook members may be pivotally coupled to the base 18 to selectively extend from the base 18 independent of each other.

Referring back to FIGS. 1A and 2, in the illustrated embodiment, the task-area light 10 is powered by a DC power source 46, such as a removable battery pack (e.g., a power tool battery pack). The battery pack 46 is insertable and removable from a receiving port 50 formed within the base 18. The receiving port 50 includes contacts for electrically coupling the battery pack 46 to the light sources 38, 62. A locking mechanism helps to retain the battery pack 46 within the receiving port 50 to inhibit the unwanted removal of the battery 46. The receiving port 50 is also electrically connected to the control panel 26, such that the control panel 26 may operate the light using the battery pack 46 positioned within the receiving port 50. In further embodiments, the task-area light 10 may be powered by an integrated battery, which may be housed within the base 18 and may be rechargeable.

In some embodiments, the base 18 also supports a power input port (e.g., an AC input). The port can connect to, for example, a wall outlet or a generator via an extension cord. The input port receives power from an AC power source to power the light 10. In further embodiments, the base 18 also or alternatively supports a power output port (e.g., an AC output and/or a DC output). The output port would allow another device (e.g., a second light, a power tool, etc.) to be plugged into the light 10, such that multiple devices to be daisy-chained together.

Figure 3B:
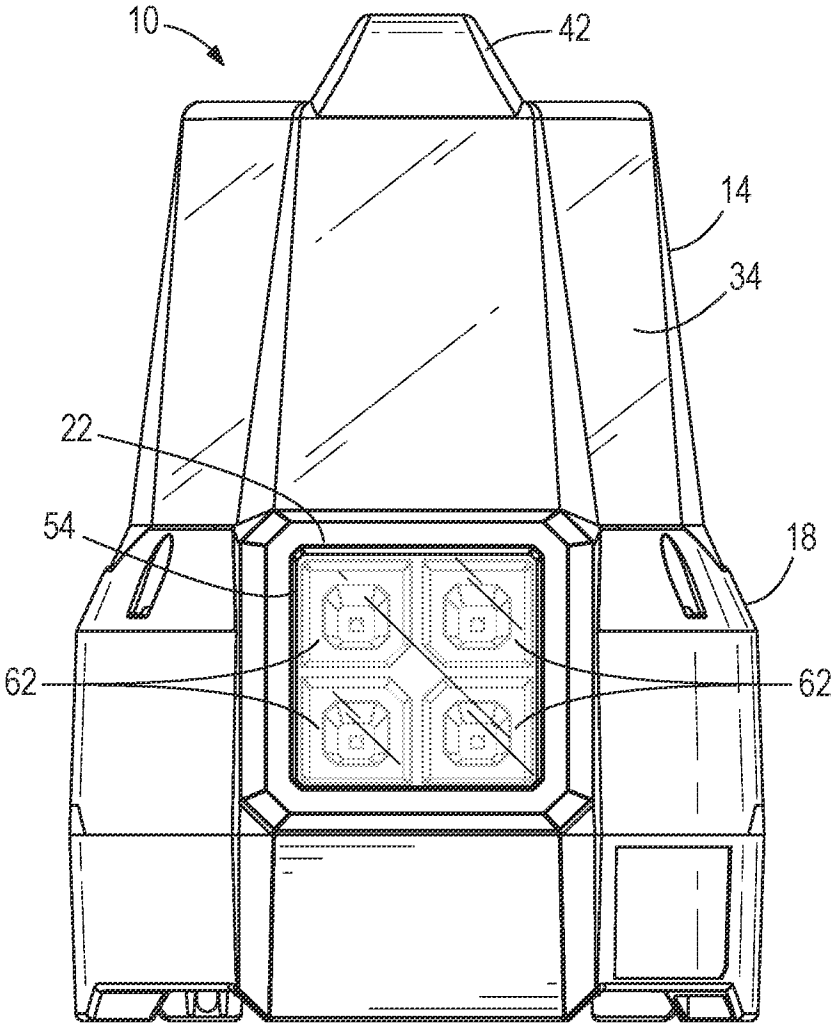
FIGS. 3A-3B are a front view and a rear view, respectively, of the task-area light shown in FIG. 1A.

With reference to FIGS. 1B, 2, 3B, and 4, the flood light 22 includes a housing 54 that is mounted to the base 18. A front face 54*a* of the housing 54 supports a lens or diffuser 58 that covers the light source 62 of the flood light 22 such that light is emitted through the lens 58. The housing 54, including the light source 62 and the lens 58, is positioned on a side of the base 18 such that the flood light 22 emits light from the side of the base 18 (as opposed to upward from the base 18 like the light source 38). Referring to FIGS. 1B and 3B, the illustrated light source 62 includes four flood light emitting diodes (LEDs), such as COB LEDs. The LEDs are arranged in a generally square grid on the side of the base 18. In other embodiments, the light source 62 may include fewer or more LEDs and/or additional lenses. A back face 54*b* of the housing 54 is coupled to a heat sink 66 that is disposed within the base 18. In further embodiments, the light source 62 includes a multi-panel light engine, multiple LEDs, or other suitable light source.

Figure 4:
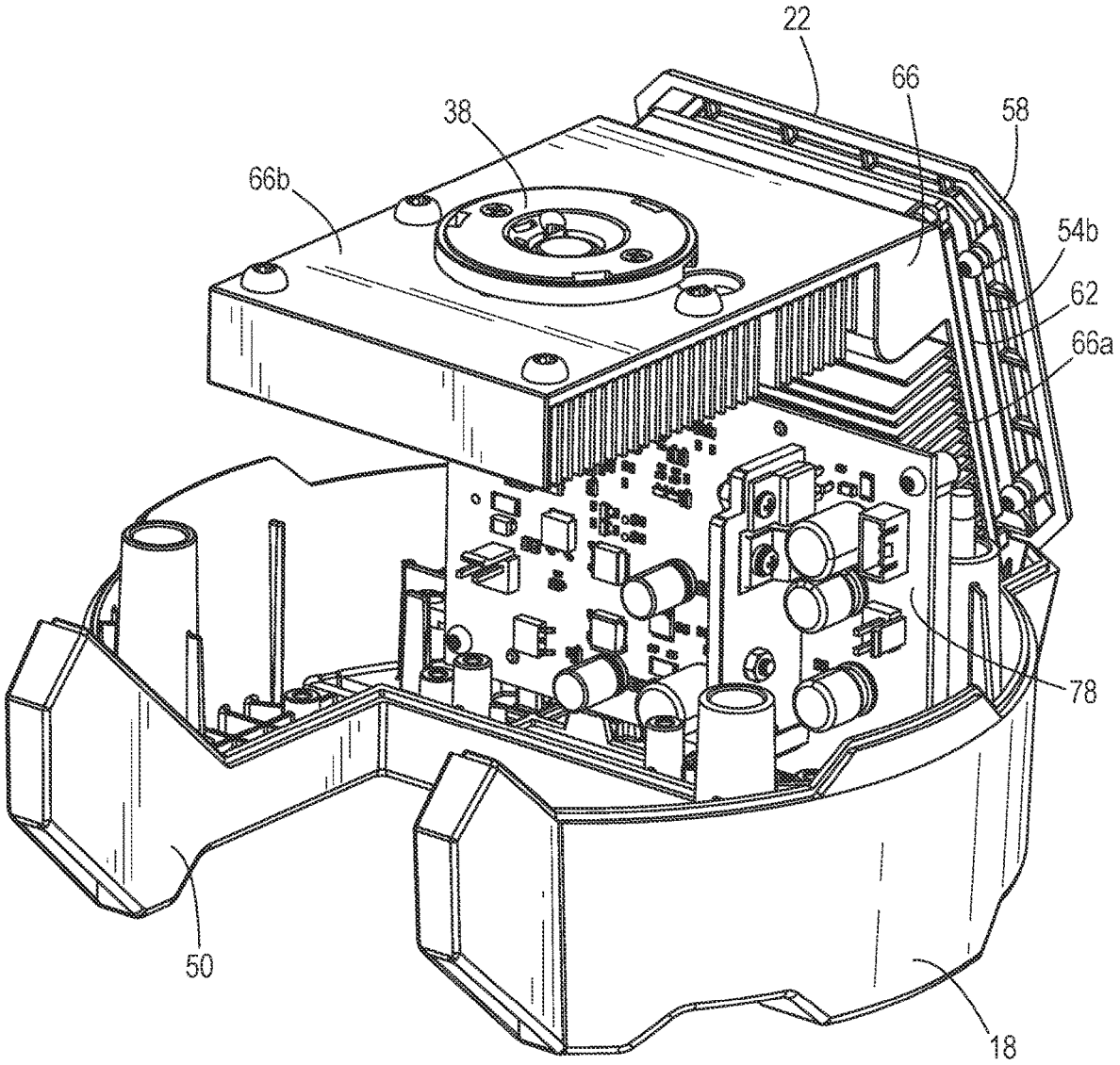
FIG. 4 is a perspective, cut-away view of the task-area light with a diffuser, a DC power source, and a portion of a base removed.

As shown in FIGS. 2 and 4, the heat sink 66 includes two portions 66*a*, 66*b*. The portions 66*a*, 66*b* are coupled together to reduce the overall size of the heatsink 66 and, thereby, the light assembly 10. The first portion 66*a* of the heat sink 66 is positioned proximate the flood light 22, and in particular behind the light source 62 to support the light source 62. The second portion 66*b* of the heat sink 66 is positioned proximate the area light 14, and in particular underneath the light source 38 to support the light source 38. In the illustrated embodiment, the second portion 66*b* is disposed at the top of the base 18 and is oriented substantially parallel to a support surface (e.g., a table, bench, etc.) that supports the light assembly 10. The first and second portions 66*a*, 66*b* of the heat sink 66 form a single, integrated piece and are angled relative to one another. In the illustrated embodiment, the second portion 66*b* is obliquely angled relative to the first portion 66*a*. However, in alternative embodiments, the portions 66*a*, 66*b* may be positioned in various orientations.

In the illustrated embodiment, the area light 14 and the flood light 22 are not operated (i.e., turned on) together because the lights 14, 22 share the same heat sink 66. In other embodiments, however, the area light 14 and the flood light 22 may both be turned on at the same time. In embodiments of the task-area light 10 where the area light 14 and the flood light 22 are not on together (i.e., ON and OFF in a separate operations), the heat sink 66 can be reduced in size. In further embodiments, the area light 14 and the flood light 22 include separate heat sinks to allow for more efficient use of the two lights 14, 22 at the same time. For example, the area light 14 and the flood light 22 may be ON or OFF are the same time, or operate independently. In addition, a circuit board 78 is positioned within the base 18 and proximate the heat sink 66, in a position not in communication with the light source 62 of the flood light 22.

Figure 3A:
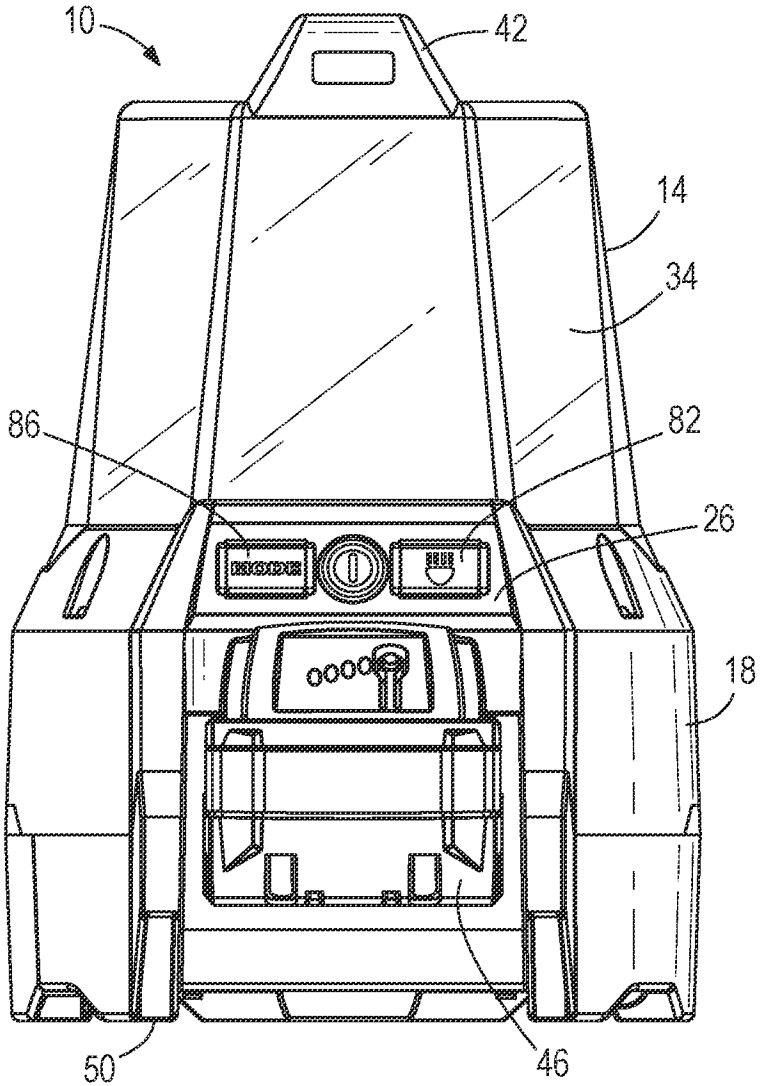

Referring to FIGS. 1A and 3A, the base 18 also supports the control panel 26. The illustrated control panel 26 includes actuators for operating the task-area light 10. For example, the actuators could be buttons, switches, or any suitable control mechanism that is configured to control the light 10. A first actuator 82 is used to turn the task-area light 10 ON and OFF. In some embodiments, the first actuator 82 turns both the area light 14 and a flood light 22 ON and OFF in a single operation; however, in other embodiments, the first actuator 82 controls the area light 14 and the flood light 22 independently. For example, pressing the first actuator sequences the light 10 through one or more of the following implementations: both lights OFF, only the area light 14 ON, only the flood light 22 ON, and both lights ON.

A second actuator 86 controls the intensity of task-area light 10. For example, the second actuator 86 operates the task-area light 10 between a high intensity, a medium intensity, and a low intensity. Other intermediate intensities may be included as well. In some embodiments, the second actuator 86 controls the intensity of both the area light 14 and the flood light 22 in a single operation; however, in other embodiments, the second actuator 86 controls the intensity of the area light 14 and the flood light 22 independently.

In one embodiment, the task-area light 10 also includes an internal control unit, such as a microcontroller or memory unit, for storing information and executable functions. The internal control unit is configured to store the state of the light 10 as set by the second actuator 86 when the task-area light 10 is powered ON and OFF by the first actuator 82. This results in a light that may be turned ON and OFF while maintaining the most recent state of the light (e.g., the section of the light turned on and the intensity level), thereby allowing the user to turn the light on with the last setting without having to readjust the light.

In some embodiments, the task-area 10 includes a power control circuit that allows the light 10 to select the power source from which, or to which, power is delivered. For example, the power control circuit could be arranged to deliver power to the light sources 38, 62 from an external power source when that power source is available and to automatically switch to or select the DC power source 46 as the source when the external source is not available. In another embodiment, the battery pack 46 could be charged by the external power source while the external power source delivers power to the light sources 38, 62.

Figure 11:
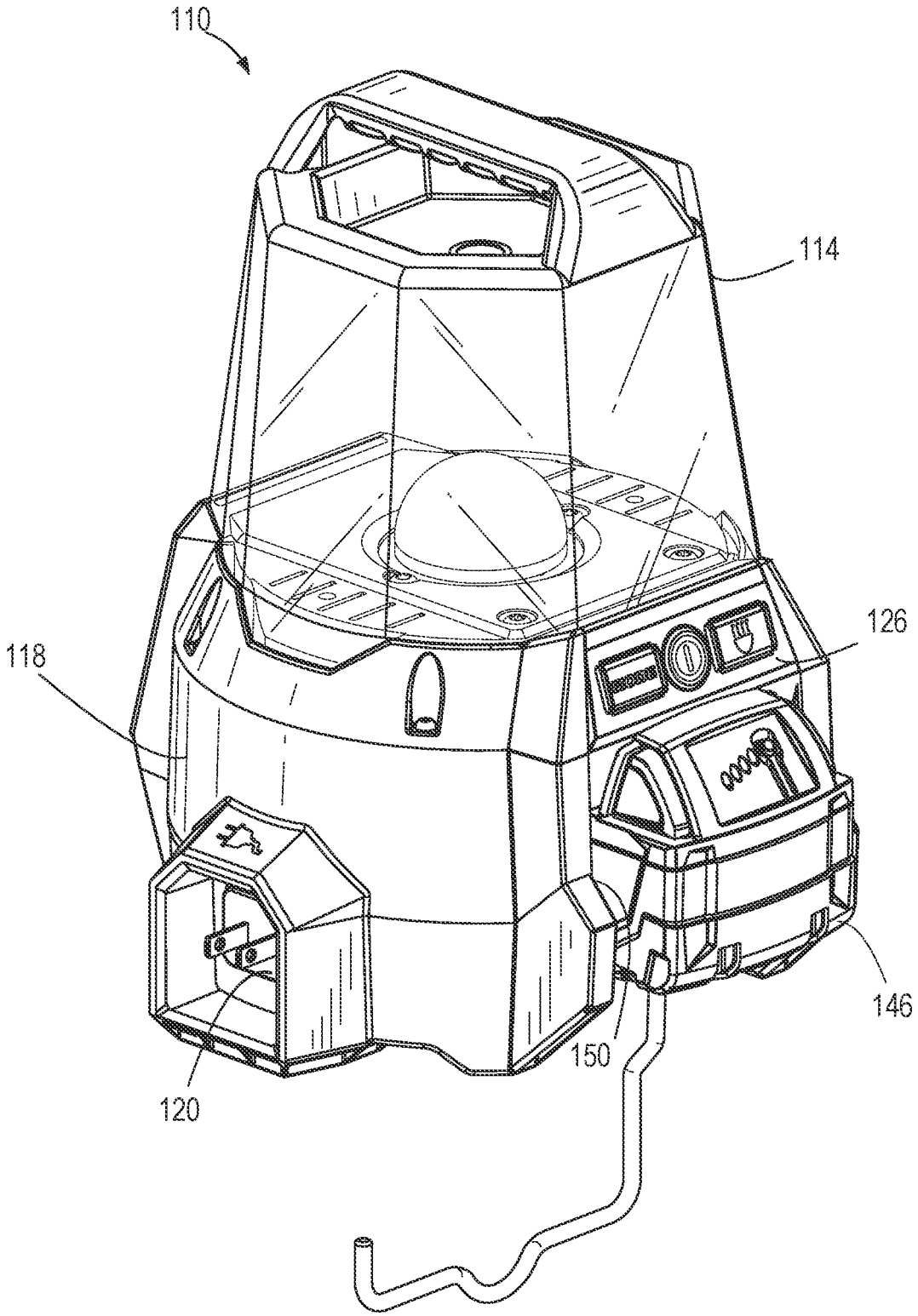
FIG. 11 is a perspective view of an alternative task-area light.
Figure 12:
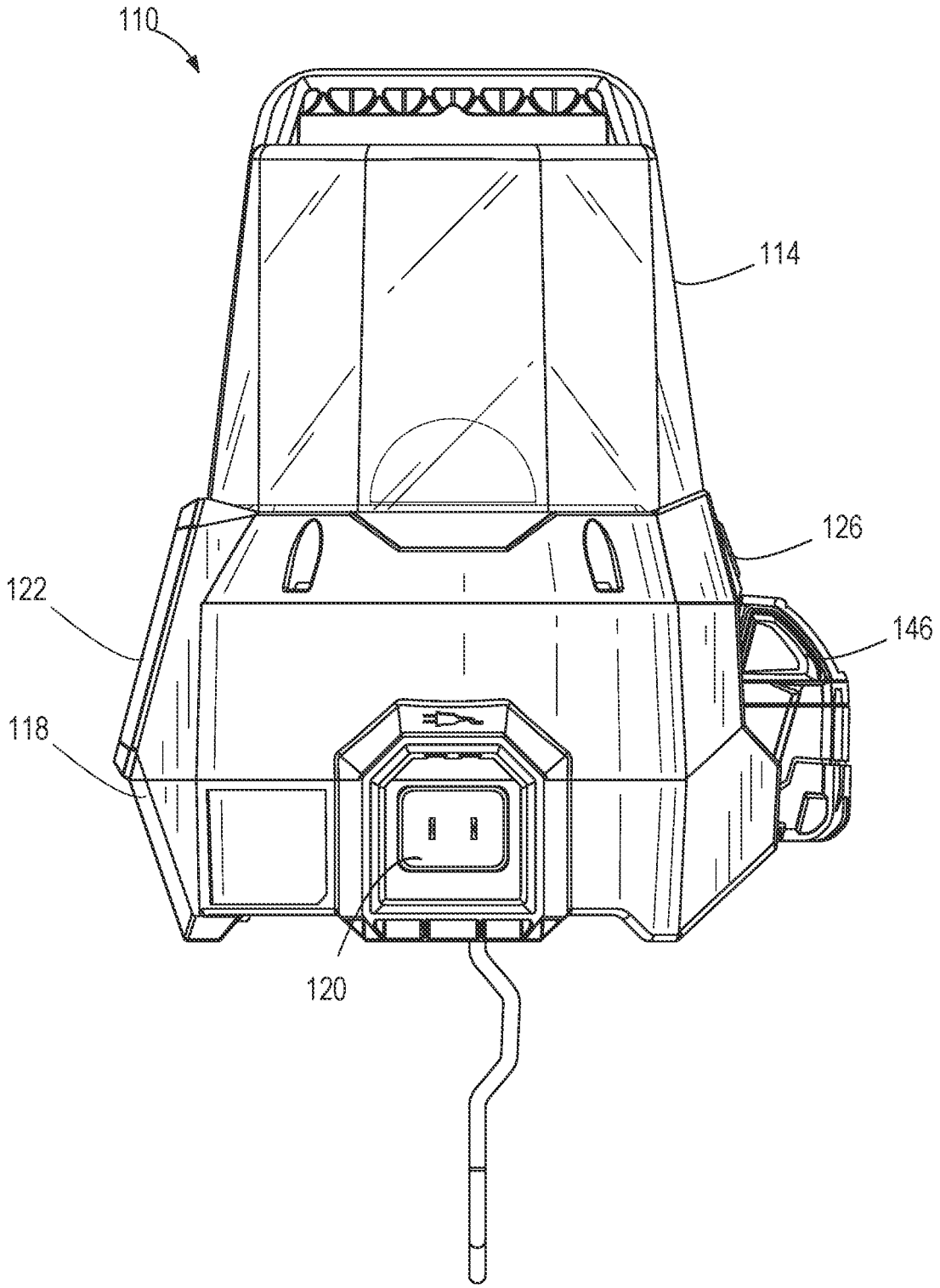
FIG. 12 is a side view of the task-area light of FIG. 11, illustrating a power input port.

FIGS. 11-12 illustrate another light assembly 110. The illustrated light assembly 110 is similar to the light assembly 10 described above with reference to FIGS. 1-10 and includes like parts. Reference is hereby made to the description of the light assembly shown in FIGS. 1-10 for description of features and elements of the light assembly 110 not specifically included below.

The illustrated task-area light 110 includes an area light 114 and a base 118. The base 118 is generally cylindrical and supports a flood light 122 and a control panel 126. The area light 114 is configured to emit light in a 360 degree range, while the flood light 122 is configured to emit light in a specific direction. The control panel 126 is electrically connected to the area light 114 and the flood light 122 to control the lights; for example, to turn the lights on and off, either together or separately.

In the illustrated embodiment, the task-area light 110 may powered by a DC power source 146, such as a removable battery pack (e.g., a power tool battery pack). The battery pack 146 is insertable and removable from a receiving port 150 formed within the base 118. The base 118 also supports a power input port 120 (e.g., an AC input). The port 120 can connect to, for example, a wall outlet or a generator via an extension cord. The input port 120 receives power from an AC power source to power the light 110.

The illustrated base 118 may additionally support a charging circuit. The charging circuit electrically couples the power input port 120 to the battery pack 146 to charge the battery pack 146. If both the battery pack 146 and the AC power source are connected to the light 110, the AC power source may charge the battery pack 146 and power the light 110. When the AC power source is disconnected from the light 110, the battery pack 146, if sufficiently charged, may automatically begin powering the light 110.

Although the invention has been described in detail with reference to certain preferred embodiments, variations and modifications exist within the scope and spirit of one or more independent aspects of the invention as described. Various features and advantages of the invention are set forth in the following claims.

What is claimed is:

1. A light assembly comprising:

a base having a first side, a second side opposite the first side, and a length defined therebetween;

a first light source supported by the base, the first light source including an area light emitting diode configured to emit light in a first direction from the base;

a second light source positioned on the first side of the base, the second light source including four flood light emitting diodes arranged in a square grid and configured to emit light in a second direction from the base;

a diffuser supported by the base, the diffuser extending upwardly from the base to enclose the first light source;

a control panel supported by the base and including an actuator operable to control operation of the light assembly; and a handle coupled to an upper end of the diffuser opposite from the base and including a grip portion configured to be grasped by a user;

wherein the grip portion extends in a direction that is generally parallel to the length.

2. The light assembly of claim 1, further comprising a lens coupled to the base to cover the second light source.

3. The light assembly of claim 1, wherein the diffuser is removably coupled to the base.

4. The light assembly of claim 1, wherein the actuator is operable to change the intensity of the first light source, the second light source, or both.

5. The light assembly of claim 1, wherein the first light source and the second light source are operable independently of each other.

6. The light assembly of claim 1, further comprising a power output supported by the base.

7. The light assembly of claim 1, further comprising a power input electrically coupled to the first light source and the second light source, the power input configured to selectively receive power from a power source.

8. The light assembly of claim 1, wherein the area light emitting diode is configured to emit light in a 360 degree range.

9. A light assembly comprising:

a base having a receiving port;

a heat sink positioned within the base, the heat sink including a first portion and a second portion that is angled relative to the first portion;

a first light source supported on the first portion of the heat sink, the first light source including an area light emitting diode configured to emit light in an upward direction from the base;

a second light source supported on the second portion of the heat sink, the second light source including a flood light emitting diode configured to emit light from a side of the base;

a diffuser supported by the base, the diffuser extending upwardly from the base to enclose the first light source; and a battery pack removably received in the receiving port of the base.

10. The light assembly of claim 9, wherein the first portion of the heat sink and the second portion of the heat sink form an integrated, single piece.

11. The light assembly of claim 9, wherein the first portion of the heat sink is obliquely oriented relative to the second portion of the heat sink.

12. The light assembly of claim 9, wherein the first light source and the second light source are operable independently of each other.

13. The light assembly of claim 9, wherein the area light emitting diode is configured to emit light in a 360 degree range.

14. The light assembly of claim 9, wherein the diffuser is removably coupled to the base.

15. A light assembly comprising:

a base having a top, a bottom, a first side, and a second side;

a first light source positioned on the top of the base, the first light source including an area light emitting diode configured to emit light in a first direction from the base;

a second light source positioned on the first side of the base, the second light source including a flood light emitting diode configured to emit light in a second direction from the base;

a diffuser positioned on the top of the base, the diffuser extending upwardly from the base to enclose the first light source;

a receiving port positioned on the second side of the base, the receiving port electrically coupled to the first light source and the second light source, the receiving port configured to selectively receive battery pack; and a control panel positioned on the second side of the base, the control panel including a power actuator.

16. The light assembly of claim 15, wherein the control panel includes a light intensity control operable to control the intensity of the first and second light sources.

17. The light assembly of claim 15, wherein the power actuator is operable to operate the first and second light sources independently or concurrently.

18. The light assembly of claim 15, further comprising a power input electrically coupled to the first light source and the second light source, the power input configured to selectively receive power from a power source that is different than the battery pack.

19. The light assembly of claim 18, wherein the receiving port is configured to selectively receive power from a DC power source, and the power input is an AC power input configured to selectively receive power from an AC power source.

20. The light assembly of claim 1, wherein the diffuser includes a top surface, and a plurality of panels extending from the top surface, and wherein each panel is planar such that the diffuser has a polygonal shape.

* * * * *